US008513554B2

(12) United States Patent
Peng

(10) Patent No.: US 8,513,554 B2
(45) Date of Patent: Aug. 20, 2013

(54) WATERPROOF SWITCH STRUCTURE

(76) Inventor: I-Sin Peng, Taichung (TW)

( * ) Notice: Subject to any disclaimer, the term of this patent is extended or adjusted under 35 U.S.C. 154(b) by 170 days.

(21) Appl. No.: 13/246,115

(22) Filed: Sep. 27, 2011

(65) Prior Publication Data

US 2013/0075240 A1 Mar. 28, 2013

(51) Int. Cl.
*H01H 9/02* (2006.01)

(52) U.S. Cl.
USPC ..... 200/332.1

(58) Field of Classification Search
USPC ..... 202/332.1, 332.2, 302.2, 302.1, 17 R, 202/51.16, 51.14, 520, 341, 293; 439/460, 439/465, 499, 454, 687, 696, 731, 906
See application file for complete search history.

(56) References Cited

U.S. PATENT DOCUMENTS 5,063,277 A * 11/1991 Takano et al. ..... 200/531
5,329,083 A * 7/1994 Lai ..... 200/302.2
2013/0037397 A1* 2/2013 Tittle ..... 200/302.2

* cited by examiner

*Primary Examiner* — Renee S Luebke
*Assistant Examiner* — Harshad Patel
(74) *Attorney, Agent, or Firm* — Jackson IPG PLLC

(57) ABSTRACT

A waterproof switch structure includes a circuit control device and a waterproof casing. The circuit control device includes a clip member, a power cord, a controller, and a circuit breaker. The waterproof casing is used to cover the controller and the circuit breaker. The waterproof casing includes an upper lid and a lower lid. The screw is screwed to the upper and lower posts to lock the upper and lower lids. The upper and lower notches of the upper and lower lids clip the power cord. The engaging grooves and the engaging ribs engage with each other. The engaging recess of the resilient cap engages with the engaging ring. The resilient cap is pressed to control operation of the press switch.

3 Claims, 4 Drawing Sheets

311
312
314
31
312
311
Fig. 1-A
21
21
22
2
311
31
34
341
314
3
352
231
351
352
35
23
24
22
321
322
32
324
324
33
33
322
321

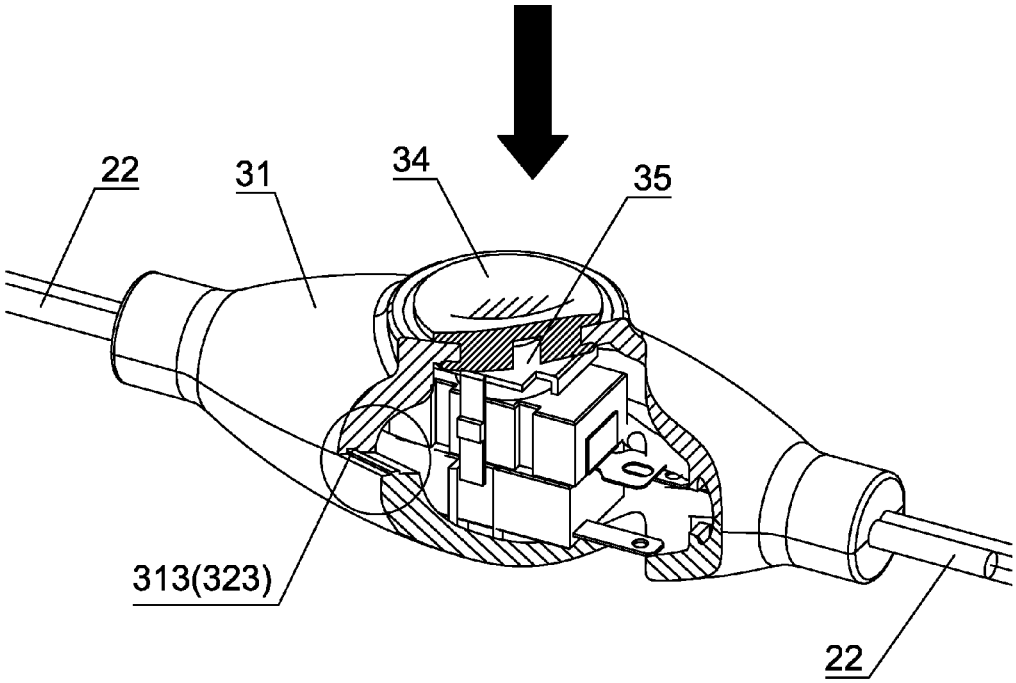
Fig. 4
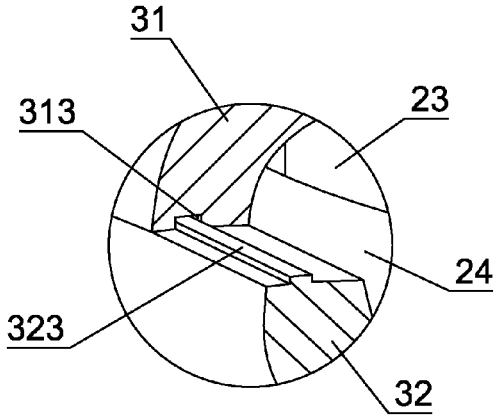
Fig. 4-A

WATERPROOF SWITCH STRUCTURE

BACKGROUND OF THE INVENTION

1. Field of the Invention

The present invention relates to a waterproof switch structure, and more particularly to a switch having a waterproof casing to protect its parts.

2. Description of the Prior Art

A conventional control switch provided on a power cord doesn't have a waterproof effect. The control switch is located far away from a device and close to a power source device. However, the user may get an electric shock to cause an accident when the control switch is used in the environment surrounding with water, such as a swimming pool, a dock or a boat. Accordingly, the inventor of the present invention has devoted himself based on his many years of practical experiences to solve these problems.

SUMMARY OF THE INVENTION

The primary object of the present invention is to provide a waterproof switch structure which comprises a circuit control device and a waterproof casing. The circuit control device comprises a clip member, a power cord, a controller, and a circuit breaker. The rear end of the clip member is connected with the power cord which is connected to a device. The power cord is connected with the controller and the circuit breaker. The controller comprises a press switch on a top thereof. The press switch is controlled by a resilient cap of the waterproof casing. The waterproof casing is used to cover the controller and the circuit breaker of the circuit control device. The waterproof casing comprises an upper lid and a lower lid. Left and right ends of the upper and lower lids have upper and lower notches. The upper and lower lids further have upper and lower threaded posts for insertion of a screw. The upper and lower lids have engaging grooves and engaging ribs at front and rear sides thereof to engage with each other. The upper lid has an engaging ring on a top end thereof for engagement an engaging recess of the resilient cap. The lower lid has two limit seats therein. The limit seats correspond in position to the resilient cap. The controller and the circuit breaker are stacked between the two limit seats. The waterproof casing further comprises a limit stand having a through hole. The limit stand is disposed on top of the controller. The press switch of the controller passes through the through hole. The limit stand has limit feet at two sides thereof. The limit feet are connected to the limit seats to be positioned thereat. The screw is screwed to the upper and lower posts to lock the upper and lower lids. The upper and lower notches at the left and right ends of the upper and lower lids clip the power cord. The engaging grooves and the engaging ribs engage with each other. The engaging recess of the resilient cap engages with the engaging ring. The resilient cap is pressed to control operation of the press switch. The present invention provides a waterproof effect.

BRIEF DESCRIPTION OF THE DRAWINGS

FIG. 1-A is a bottom view of the upper lid according to the preferred embodiment of the present invention;

FIG. 4 is a partial sectional view according to the preferred embodiment of the present invention; and FIG. 4-A is an enlarged view showing the engaging grooves and the engaging ribs of the upper and lower lids according to the preferred embodiment of the present invention.

DETAILED DESCRIPTION OF THE PREFERRED EMBODIMENTS

Embodiments of the present invention will now be described, by way of example only, with reference to the accompanying drawings.

Figure 1:
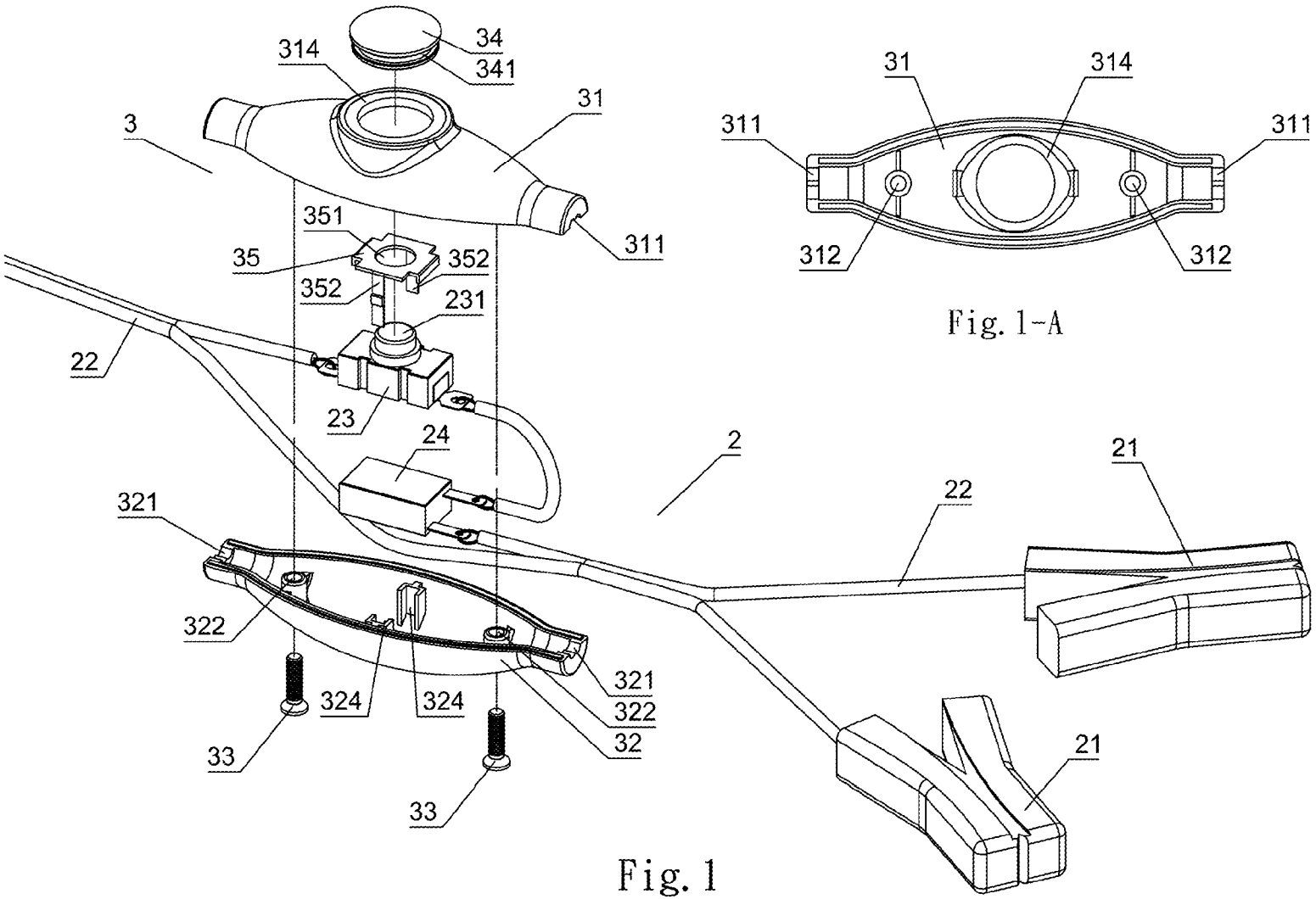
FIG. 1 is an exploded view according to a preferred embodiment of the present invention.
Figure 2:
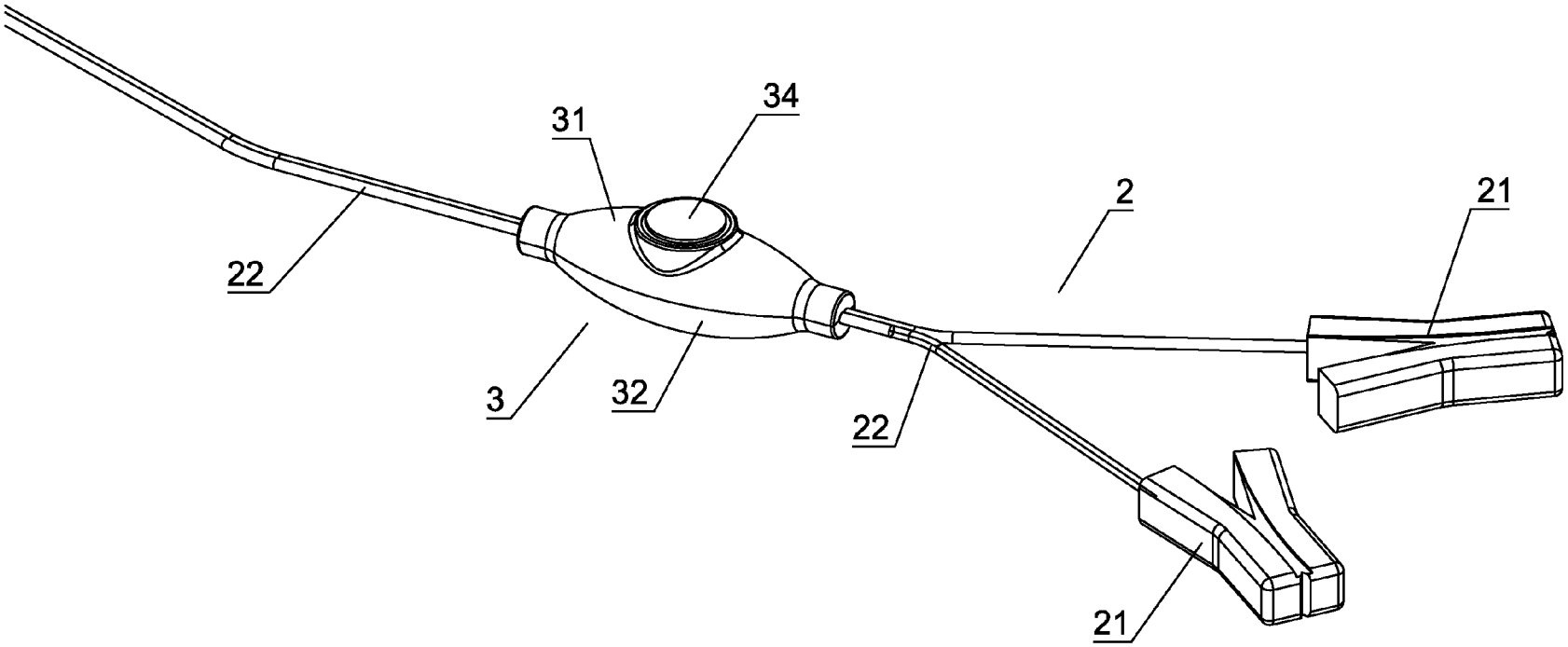
FIG. 2 is a perspective view according to the preferred embodiment of the present invention.
Figure 3:
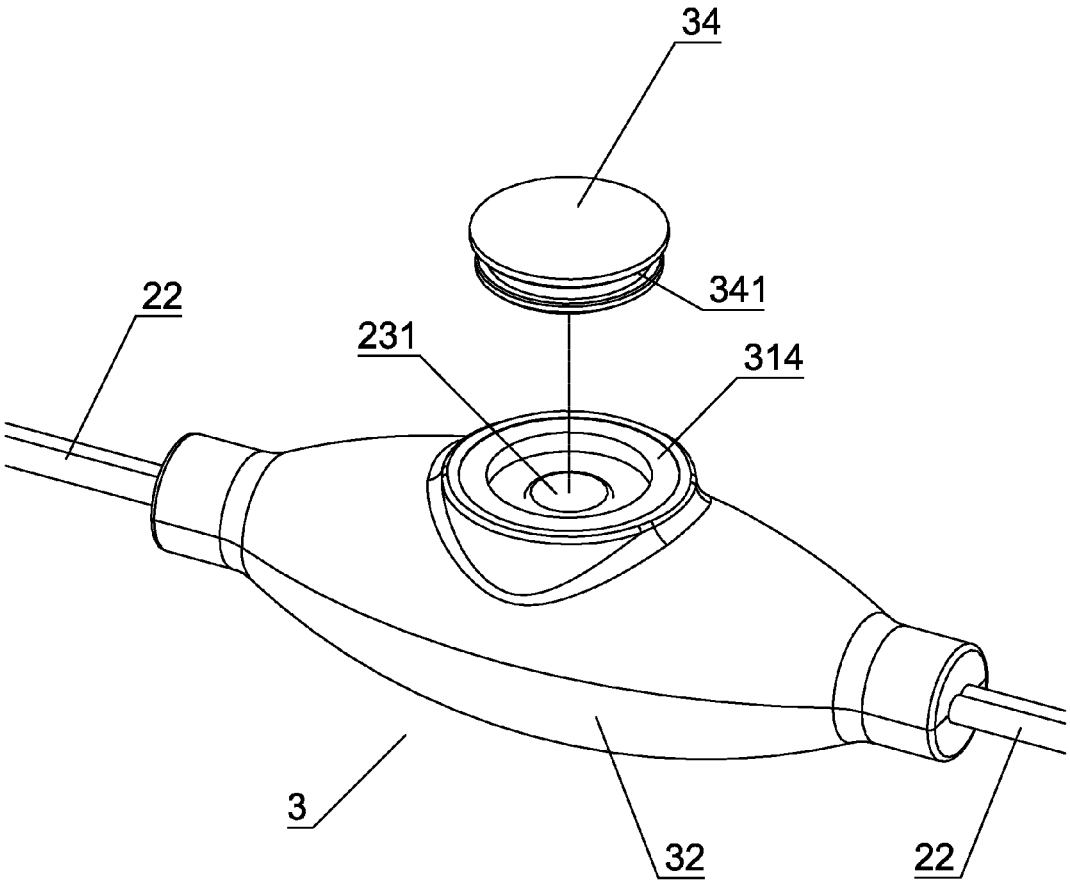
FIG. 3 is a perspective view showing the resilient cap and the press switch according to the preferred embodiment of the present invention.

As shown in FIG. 1 through FIG. 3 and FIG. 1-A, the waterproof switch structure according to a preferred embodiment of the present invention comprises a circuit control device 2 and a waterproof casing 3.

The circuit control device 2 comprises a clip member 21, a power cord 22, a controller 23, and a circuit breaker 24. The rear end of the clip member 21 is connected with the power cord 22 which is connected to a device for inputting a power source to the device. The power cord 22 is connected with the controller 23 and the circuit breaker 24 to control the switch and to protect a broken circuit. The controller 23 comprises a press switch 231 on a top thereof. The press switch 231 is controlled by a resilient cap 34 of the waterproof casing 3.

The waterproof casing 3 is used to cover and protect the controller 23 and the circuit breaker 24, and is composed of an upper lid 31 and a lower lid 32. Left and right ends of the upper and lower lids 31, 32 have upper and lower notches 311, 321. The diameter defined by the upper and lower notches 311, 321 is smaller than that of the power cord 22 so as to seal the power cord 22 and to provide a waterproof effect. The upper and lower lids 31, 32 further have upper and lower threaded posts 312, 322 for insertion of a screw 33. The upper and lower lids 31, 32 have engaging grooves 313 and engaging ribs 323 at front and rear sides thereof to engage with each other so as to block water. The upper lid 31 has an engaging ring 314 on a top end thereof for engagement an engaging recess 341 of the resilient cap 34. The lower lid 32 has two limit seats 324 therein. The limit seats 324 correspond in position to the resilient cap 34, such that the controller 23 and the circuit breaker 24 are stacked between the two limit seats 324. The waterproof casing 3 further comprises a limit stand 35 having a through hole 351. The limit stand 35 is disposed on top of the controller 23, and the press switch 231 of the controller 23 passes through the through hole 351. The limit stand 35 has limit feet 352 at two sides thereof. The limit feet 352 are connected to the limit seats 324 to be positioned thereat. The resilient cap 34 is used to control operation of the press switch 231. The present invention provides a waterproof switch which is convenient for use.

Referring to FIG. 2 to FIG. 4 and FIG. 4-A, the controller 23 and the circuit breaker 24 are connected with the power cord 22. The limit stand 35, the controller 23 and the circuit breaker 24 are located between the two limit seats 324 of the lower lid 32. The press switch 231 extends out of the through hole 351. The limit feet 352 are positioned at the limit seats 324. The upper lid 31 is coupled to the lower lid 32 by means of engagement of the upper and lower notches 311, 321, the upper and lower threaded posts 312, 322, the engaging grooves 313 and the engaging ribs 323, and then the screw 33 are is screwed to the upper and lower posts 312, 322 to lock the upper and lower lids 31, 32. The upper and lower notches

311, 321 at the left and right ends of the upper and lower lids 31, 32 clip the power cord 22, and the engaging grooves 313 and the engaging ribs 323 engage with each other, and the engaging recess 341 of the resilient cap 34 engages with the engaging ring 314. The user can press the resilient cap 34 to control operation of the press switch 231. The controller 23 and the circuit breaker 24 are wrapped by the upper and lower lids 31, 32. The present invention provides a waterproof effect and is cost-effective.

The engaging grooves 313 and the engaging ribs 323 are disposed at the front and rear sides of the upper and lower lids 31, 32. The engaging ribs 323 can be rubber strips disposed in the engaging grooves 313. In this way, the upper and lower lids 31, 32 also have the same waterproof effect after locked.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A waterproof switch structure, comprising:

a circuit control device comprising a clip member, a power cord, a controller, and a circuit breaker, a rear end of the clip member being connected with the power cord which is connected to a device, the power cord being connected with the controller and the circuit breaker, the controller comprising a press switch on a top thereof, the press switch being controlled by a resilient cap; and a waterproof casing to cover the controller and the circuit breaker of the circuit control device, the waterproof casing comprising an upper lid and a lower lid, left and right ends of the upper and lower lids having upper and lower notches, the upper and lower lids further having upper and lower threaded posts for insertion of a screw, the upper and lower lids having engaging grooves and engaging ribs at front and rear sides thereof to engage with each other, the upper lid having an engaging ring on a top end thereof for engagement with an engaging recess of the resilient cap, the lower lid having two limit seats therein, the limit seats corresponding in position to the resilient cap, the controller and the circuit breaker being stacked between the two limit seats, the waterproof casing further comprising a limit stand having a through hole, the limit stand being disposed on top of the controller, the press switch of the controller passing through the through hole, the limit stand having limit feet at two sides thereof, the limit feet being connected to the limit seats to be positioned thereat;

thereby, the screw being screwed to the upper and lower posts to lock the upper and lower lids, the upper and lower notches at the left and right ends of the upper and lower lids clipping the power cord, the engaging grooves and the engaging ribs engaging with each other, the engaging recess of the resilient cap engaging with the engaging ring, the resilient cap being pressed to control operation of the press switch.

2. The waterproof switch structure as claimed in claim 1, wherein a diameter defined by the upper and lower notches is smaller than a diameter of the power cord.

3. The waterproof switch structure as claimed in claim 1, wherein the engaging ribs are rubber strips disposed in the engaging grooves.

* * * * *